US007918716B2

(12) United States Patent
Oliver

(10) Patent No.: US 7,918,716 B2
(45) Date of Patent: Apr. 5, 2011

(54) MATING SYSTEMS AND METHODS FOR JOINING COATED ABRASIVES

(75) Inventor: Christophe Oliver, Dover, MA (US)

(73) Assignees: Saint-Gobain Abrasives, Inc., Worcester, MA (US); Saint-Gobain Abrasifs, Conflans-Saint-Honorine (FR)

( * ) Notice: Subject to any disclaimer, the term of this patent is extended or adjusted under 35 U.S.C. 154(b) by 0 days.

(21) Appl. No.: 11/638,104

(22) Filed: Dec. 13, 2006

(65) Prior Publication Data

US 2008/0146130 A1 Jun. 19, 2008

(51) Int. Cl.
*B24D 11/00* (2006.01)

(52) U.S. Cl. ..... 451/531; 451/56

(58) Field of Classification Search ..... 451/531, 451/56

See application file for complete search history.

(56) References Cited

U.S. PATENT DOCUMENTS

| | | | | | |
|---|---|---|---|---|---|
| 241,152 | A | * | 5/1881 | Obart | 451/531 |
| 2,215,210 | A | * | 9/1940 | Dahlstrom | 451/531 |
| 2,391,731 | A | * | 12/1945 | Miller et. al. | 451/531 |
| 2,413,325 | A | * | 12/1946 | Horton | 451/531 |
| 3,053,020 | A | * | 9/1962 | Bratton | 451/531 |
| 3,154,897 | A | * | 11/1964 | Howard | 451/531 |
| 3,427,765 | A | * | 2/1969 | McGarvey | 451/531 |
| 3,564,782 | A | * | 2/1971 | Haywood | 451/531 |
| 3,623,282 | A | * | 11/1971 | Norris, III | 451/531 |
| 3,665,660 | A | * | 5/1972 | Malloy et al. | 451/531 |
| 3,765,329 | A | | 10/1973 | Kirkpatrick et al. | |
| 3,977,618 | A | | 8/1976 | Kato et al. | |
| 5,549,193 | A | * | 8/1996 | Schlueter et al. | 198/844.2 |
| 5,601,676 | A | * | 2/1997 | Zimmerman et al. | 156/98 |
| 5,951,383 | A | * | 9/1999 | Eisenblaetter | 451/296 |
| 7,052,426 | B2 | * | 5/2006 | Battat et al. | 474/253 |
| 2003/0132153 | A1 | | 7/2003 | Jelten | |
| 2006/0014481 | A1 | | 1/2006 | Barous | |
| 2006/0025047 | A1 | * | 2/2006 | Billig | 451/5 |

FOREIGN PATENT DOCUMENTS

| | | | |
|---|---|---|---|
| DE | 8904270 | U1 | 5/1989 |
| DE | 19931290 | A1 | 1/2001 |
| EP | 0452593 | B1 | 10/1991 |
| GB | 578567 | A | 7/1946 |

* cited by examiner

*Primary Examiner* — Maurina Rachuba
(74) *Attorney, Agent, or Firm* — Larson Newman & Abel, LLP; Joseph P. Sullivan

(57) ABSTRACT

Mating systems and methods for joining coated abrasives. The mating system comprises mating portions positioned at coated abrasive end portions. Complimentary mating portions may be used to join coated abrasives without glue or mechanical attachment. The mating system of the present invention may be used to join a coated abrasive to itself, or to join multiple coated abrasives to each other.

11 Claims, 3 Drawing Sheets

MATING SYSTEMS AND METHODS FOR JOINING COATED ABRASIVES

BACKGROUND OF THE INVENTION

1. Field of the Invention

The present invention relates generally to coated abrasives and, more particularly, to mating systems and methods for joining coated abrasives.

2. Discussion of Related Art

Coated abrasives are used in a variety of surface-treatment applications, such as smoothing and polishing, and in a wide range of markets including the automotive, wood-working, welding and jewelry industries. In general, coated abrasives are manufactured by binding abrasive grains to a flexible backing material. Coated abrasives are produced in many sizes, thicknesses and shapes, including disks, sheets, belts and rolls.

Coated abrasives tend to be disposable articles, requiring replacement as the coated abrasive is worn-down with use. In certain applications, a source of coated abrasive, most typically a roll, may be supplied to a machine, for example a camshaft or crankshaft superfinishing machine. The roll may be advanced through the machine over time to consistently provide effective coated abrasive at a point of contact with a work piece. To replace a source of coated abrasive, such as a roll, for repair or continued operation, machine operators typically join ends together to generate a continuous source of coated abrasive, rather than reintroducing a source of coated abrasive to the machine. The sources of coated abrasive are typically joined by mechanical or adhesive means, such as with staples, fasteners or glue.

BRIEF SUMMARY OF THE INVENTION

In accordance with one or more embodiments, the invention relates generally to a mating system and method for joining coated abrasives.

In accordance with one or more embodiments, the invention relates to a coated abrasive comprising a first end portion, a second end portion, and a mating system comprising a first mating portion, and a second mating portion. The first and second mating portions are positioned respectively at the first and second end portions of the coated abrasive.

In accordance with one or more embodiments, the invention relates to a method of joining coated abrasives, comprising locating a first coated abrasive mating portion, and interconnecting a complimentary coated abrasive mating portion with the first coated abrasive mating portion.

In accordance with one or more embodiments, the invention relates to a method of facilitating installation of a coated abrasive, comprising providing a coated abrasive comprising: a first end portion, a second end portion, and a mating system comprising a first mating portion, and a second mating portion. The first and second mating portions are positioned respectively at the first and second end portions of the coated abrasive.

Other advantages, novel features and objects of the invention will become apparent from the following detailed description of the invention when considered in conjunction with the accompanying drawings.

BRIEF DESCRIPTION OF THE DRAWINGS

The accompanying drawings are not intended to be drawn to scale. In the drawings, each identical or nearly identical component that is illustrated in various figures is represented by like numeral. For purposes of clarity, not every component may be labeled in every drawing. Preferred, non-limiting embodiments of the present invention will be described with reference to the accompanying drawings, in which.

DETAILED DESCRIPTION OF THE INVENTION

Figure 1:
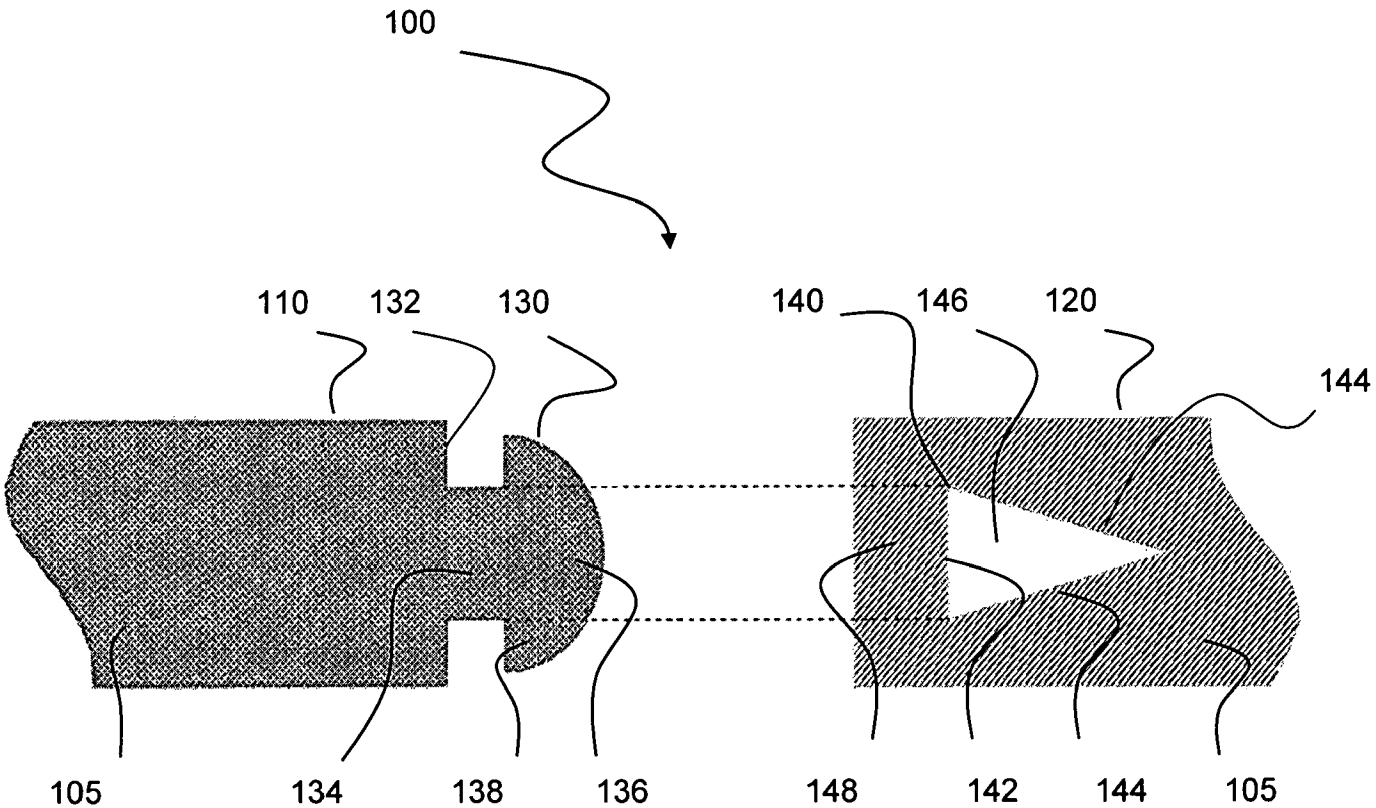
FIG. 1 illustrates a coated abrasive mating system in accordance with one or more embodiments of the invention.

This invention is not limited in its application to the details of construction and the arrangement of components as set forth in the following description or illustrated in the drawings. The invention is capable of embodiments and of being practiced or carried out in various ways beyond those exemplarily presented herein.

In accordance with one or more embodiments, the present invention relates generally to coated abrasives utilized in a variety of surface-treatment applications. As used herein, the term "coated abrasive" refers to an article manufactured by binding abrasive grains to a backing material. The backing material is typically flexible, and may be made of any material capable of receiving the abrasive grains, such as a paper, cloth, fiber or a film, for example a polyester film. The abrasive grains may be any particles capable of treating a contacted surface, such as to scour, scrub, smooth or polish the surface. The abrasive grains may be formed from natural or synthetic materials and may be of varying size and hardness. Abrasive grains may include, for example, aluminum oxide, silicon carbide, zirconia alumina, garnet, emery, or mixtures thereof. A binder, such as a glue or resin, is typically used to adhere the abrasive grains to the backing. Coated abrasives may be formed in a variety of shapes and sizes, including discs, sheets, belts, or rolls, and may also include a backcoat for enhanced performance, such as an anti-slip backcoat. Without limiting the scope of the invention, a typical coated abrasive may be about 2 to 6 millimeters thick, and about 0.25 to 5 inches wide. A typical coated abrasive roll may be about 150 to 1200 feet in length. More specifically, the present invention may relate to coated abrasives such as those described in U.S. Pat. Nos. 5,014,468; 5,833,724; 5,840,088; 5,863,306 and 6,451,076, each of which is incorporated herein by reference in its entirety.

According to one or more embodiments, the present invention relates to coated abrasives having one or more end portions. As used herein, the term "end portion" refers generally to any coated abrasive segment that is capable of being joined to another coated abrasive segment. An end portion may be positioned anywhere on a coated abrasive. For example, an end portion may be positioned towards the center of a coated abrasive, at an edge of a coated abrasive, or at any intermediate position. Some embodiments of the present invention relate to a coated abrasive source, such as a roll, having a first end portion and a second end portion. The first and second end portions may be positioned respectively at the beginning and end of the coated abrasive roll.

In accordance with one or more embodiments, the present invention relates to coated abrasives having a mating system. As used herein, the term "mating system" refers generally to any system for joining end portions of one or more coated abrasives without mechanical or adhesive means. The mating system may be based solely on the structure of one or more coated abrasives. The mating system results in a joint between end portions of sufficient strength to meet the requirements of an intended application. It may be desirable to join end portions of one or more coated abrasives in a number of situations. For example, the mating system may be used to join end portions of a single coated abrasive, such as to secure a coated abrasive around a drum or similar device. Alternatively, the mating system may be used to join end portions of different coated abrasives, such as to generate a continuous source of coated abrasive, increase the available surface area of coated abrasive, or rejoin a torn portion of coated abrasive to prevent waste. Additionally, the mating system may seek to avoid unnecessary overlap of joined end portions, if desired, such as to prevent any negative impact which may result from increased thickness at a coated abrasive joint.

The mating system of the present invention may comprise one or more mating portions. The mating system may utilize complimentary mating portions to join one or more coated abrasives. As used herein, the term "mating portion" refers to a segment of coated abrasive which is configured to compliment another segment of coated abrasive to facilitate the joining of one or more coated abrasives. A mating portion may be of any shape and size and should generally correspond to a complimentary mating portion positioned on the same or a different coated abrasive to facilitate joining. A mating portion may be coextensive with a width of the coated abrasive or may be narrower. A plurality of mating portions may be positioned on a coated abrasive, such as along a length of the coated abrasive, for joining flexibility. For example, the plurality of mating portions may be of varying shapes and sizes.

In some embodiments, a first mating portion may be positioned at a first end portion of a coated abrasive, and a second mating portion may be positioned at a second end portion of a coated abrasive. The first and second end portions may be part of the same coated abrasive or each may be part of a separate coated abrasive. The first and second mating portions may be substantially similar. Alternatively, the first and second mating portions may be different, such as to compliment each other. More specifically, the first mating portion may be configured to couple with the second mating portion to join one or more coated abrasives. For example, the first mating portion may be configured to interconnect with the second mating portion. In some embodiments, the first mating portion may be configured to receive the second mating portion to facilitate the joining of coated abrasive ends.

Thus, in accordance with one or more embodiments of the present invention, coated abrasive ends can be joined by locating a first coated abrasive mating portion and coupling it to a complimentary coated abrasive mating portion. For example, the first mating portion may be interconnected with the complimentary mating portion. The first mating portion and the complimentary mating portion may belong to the same coated abrasive or, alternatively, may belong to different coated abrasives, depending on the desired application.

FIG. 1 illustrates a coated abrasive mating system 100 in accordance with one or more embodiments of the present invention. First and second end portions 110, 120 comprise first and second mating portions 130, 140 respectively. In the illustrated embodiment, first and second mating portions 130, 140 are complimentary.

Second mating portion 140 comprises a base 142 and sides 144 defining cut-out 146. First mating portion 130 comprises shoulder 132, neck 134, and head 136. The width of neck 134 defines shoulder 132, and is consistent with base 142 to avoid undesirable gaps and movement in a joint resulting from mating system 100. Likewise, neck 134 is consistent with margin 148, and is of adequate depth so as to enable mating while preventing gaps and excessive movement. Shoulder 132 may further restrict movement of end portions 110, 120 in a resulting joint. Head 136 comprises flexible wings 138 capable of bending for insertion into cut-out 146. The degree to which sides 144 are tapered may control the extent to which flexible wings 138 are bent during assembly. Wings 138 generally extend beyond base 142 to allow secure coupling of the first and second end portions 110 120. The width of neck 132 and span of wings 138 may, in part, influence the strength of a resulting joint between coated abrasive end portions 110, 120. Abrasive grains 105 are provided uniformly over the entire surface of end portions 1110, 120, including mating portions 130, 140, enabling mating system 100 to result in a continuous coated abrasive surface.

Figure 2:
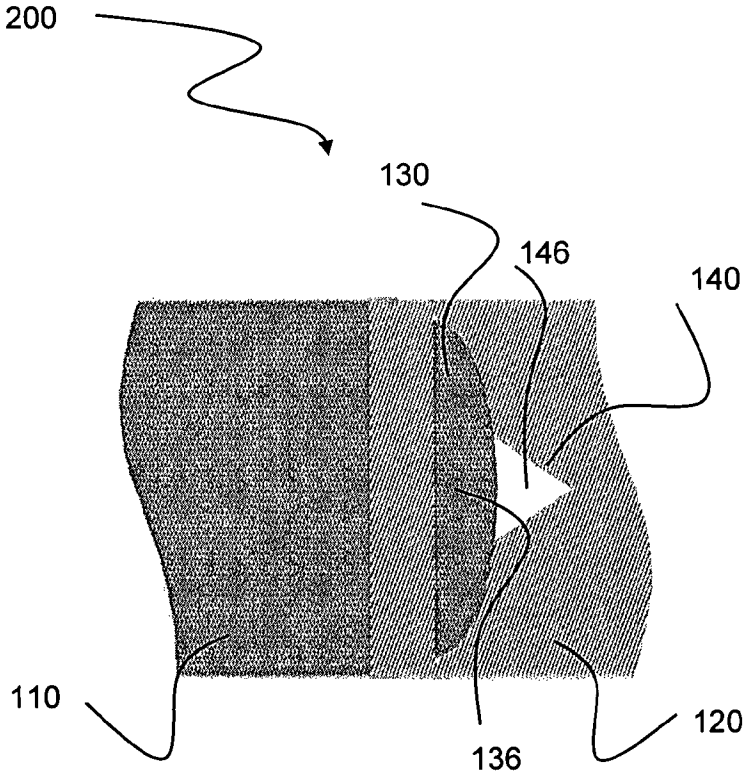
FIG. 2 illustrates a joint formed by the mating system shown in FIG. 1 between two end portions of coated abrasives in accordance with one or more embodiments of the invention.

FIG. 2 illustrates a joint 200 formed by the coated abrasive mating system 100 of FIG. 1 in accordance with one or more embodiments of the present invention. First mating portion 130 is positioned at first end portion 110 and second mating portion 140 is positioned at second end portion 120. Second end portion 120 is complimentary to first mating portion 130, and may be configured to receive first mating portion 130 as illustrated. The first and second end portions 110, 120 are coextensive in width, such that joint 200 results in a consistent coated abrasive surface. Cut-out 146 and head 136 may be shaped and sized to add strength to joint 200 while attempting to avoid any undesirable gap.

As discussed above, first and second end portions 110, 120 may be part of the same coated abrasive or part of different coated abrasives. If first and second end portions 110, 120 belong to the same coated abrasive, then joint 200 results from joining a single coated abrasive to itself. In applications where first and second end portions 110, 120 belong to different coated abrasives, then joint 200 results from joining two coated abrasives to each other.

Figure 3:
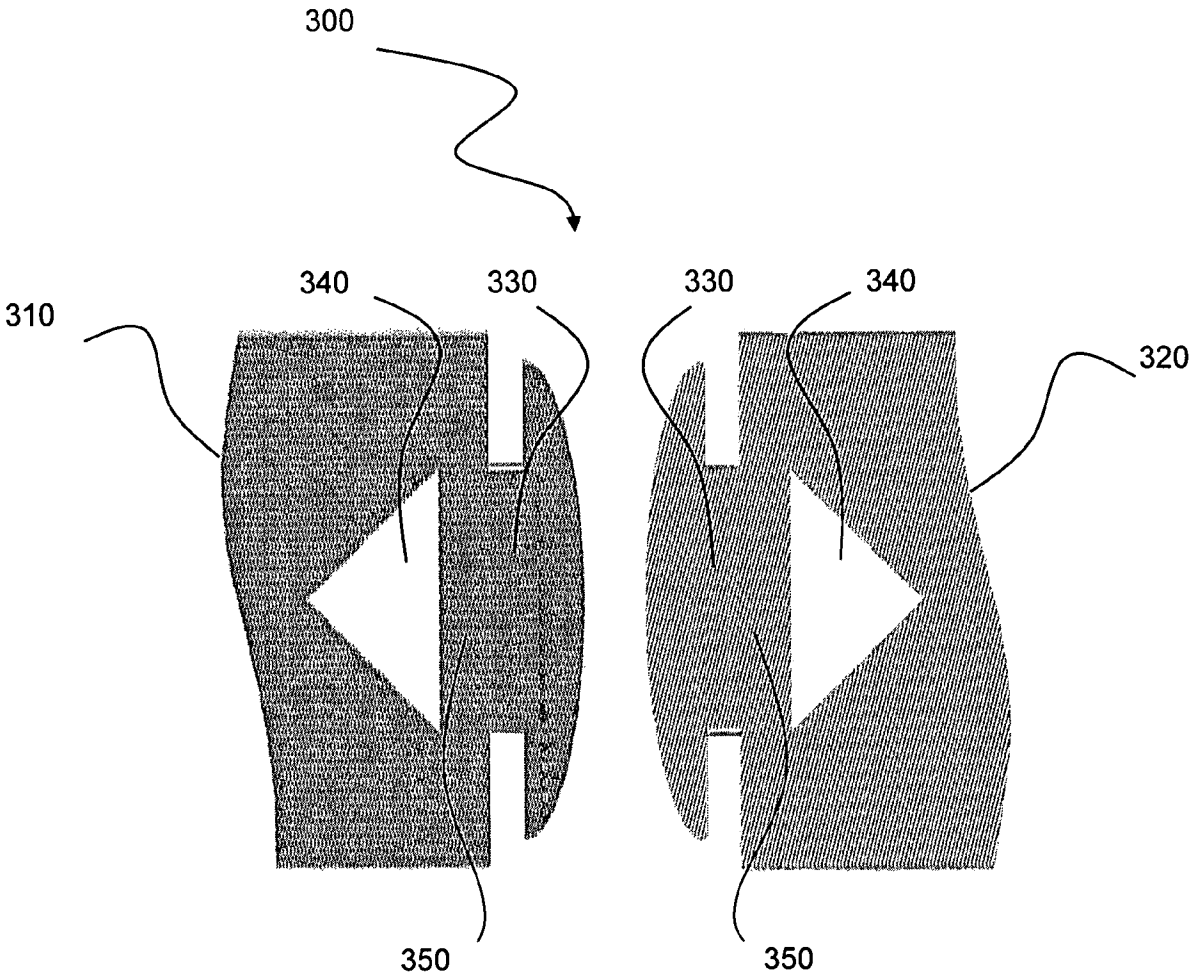
FIG. 3 illustrates complimentary pairs of mating portions at coated abrasive end portions in accordance with one or more embodiments of the invention.

FIG. 3 illustrates an alternative coated abrasive mating system 300. Mating system 300 comprises a pair of first and second mating portions 330, 340 at each coated abrasive end portion 310, 320. As illustrated, first and second mating portions 330, 340 may compliment each other. Intermediate space 350 is adequate to enable simultaneous use of both the first and second mating portions 330, 340. Thus, either one or both of the mating portions 330, 340 at each end portion 310, 320 may be used in forming a joint to produce a continuous source of coated abrasive. The configuration of mating system 300 may be desirable so as to ensure end portion to end portion compatibility. Also, mating system 300 may provide extra strength at a joint when both the first and second mating portions 330, 340 at each end portion 310, 320 are used in conjunction with each other. The same structural considerations as discussed above, in reference to the embodiment illustrated in FIGS. 1 and 2, may be applied to the design of first and second mating portions 330, 340.

In addition to the nonlimiting embodiments illustrated above, other mating systems are contemplated for use in joining one or more coated abrasives without mechanical or adhesive means. As discussed, the one or more mating portions of the present invention may be of any shape, size and configuration capable of resulting in a continuous source of coated abrasive with sufficient strength for an intended use. The types of coated abrasives involved and the desired application may influence the design of the mating system.

The one or more mating portions of the present invention may be formed integral to the coated abrasives during manufacture. The invention also contemplates attachment of one or more mating portions to a coated abrasive. Alternatively, a tool may be used to form one or more mating portions, such as by cutting-out one or mating portions in a coated abrasive.

The mating systems of the present invention generally do not involve an adhesive or a mechanical attachment. It is envisioned, however, that the mating systems of the present invention may be used in conjunction with traditional joining techniques, such as mechanical or adhesive means. For example, the mating system of the present invention may be used in addition to glue or staples.

The mating systems of the present invention may be used to join one or more coated abrasives of the same kind. Alternatively, it is also contemplated that one variety of coated abrasive may be joined to a different variety of coated abrasive. For example, coated abrasives with different textures or abrasive grain-types may be joined for various desired applications.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize, or be able to ascertain, using no more than routine experimentation, equivalents to the specific embodiments of the invention. It is therefore to be understood that the embodiments described herein are presented by way of example only and that, within the scope of the appended claims and equivalents thereto, the invention may be practiced otherwise than as specifically described.

What is claimed is:

1. A coated abrasive system, comprising:

a first coated abrasive roll having first and second end portions;

a second coated abrasive roll having first and second end portions, the second coated abrasive roll being distinct from the first coated abrasive roll; and a mating system comprising a first mating portion and a second mating portion positioned respectively at the second end portion of the first coated abrasive roll and at the first end portion of the second coated abrasive roll, each mating portion consisting of an opening and a projection, each opening extending through the thickness of the respective mating portion and surrounded by the mating portion, the opening of the first mating portion shaped to receive the projection of the second mating portion and the opening of the second mating portion shaped to receive the projection of the first mating portion, wherein the first and second mating portions have substantially the same geometric shape and at least one of (i) the opening of the first mating portion is configured to interconnect with the projection of the second mating portion without the use of an adhesive, and (ii) the projection of the first mating portion is configured to interconnect with the opening of the second mating portion without the use of an adhesive.

2. The coated abrasive system of claim 1, wherein the first mating portion is configured to couple with the second mating portion.

3. The coated abrasive system of claim 1, wherein at least one of the first and second mating portions is coextensive with a width of the first coated abrasive roll.

4. The coated abrasive system of claim 1, further comprising a plurality of first mating portions positioned along a length of the first coated abrasive roll.

5. The coated abrasive system of claim 4, further comprising a plurality of second mating portions positioned along the length of the second coated abrasive roll.

6. The coated abrasive system of claim 1, wherein the mating system does not use a mechanical attachment.

7. A method of joining coated abrasives, comprising:

locating a first coated abrasive mating portion on a first coated abrasive roll; and interconnecting a complimentary coated abrasive mating portion on a second coated abrasive roll with the first coated abrasive mating portion, wherein the second coated abrasive roll is distinct from the first coated abrasive roll, wherein the first and second coated abrasive mating portions have substantially the same geometric shape, each of the first and second coated abrasive mating portions includes an opening and a projection, each opening extending through the thickness of the respective mating portion and surrounded by the mating portion, the opening of the first mating portion shaped to receive the projection of the second mating portion, the opening of the second mating portion shaped to receive the projection of the first mating portion, and at least one of (i) the opening of the first mating portion is configured to interconnect with the projection of the second mating portion without the use of an adhesive, and (ii) the projection of the first mating portion is configured to interconnect with the opening of the second mating portion without the use of an adhesive.

8. The method of claim 7, further comprising a step of forming at least one of the mating portions.

9. A method of facilitating installation of a coated abrasive, comprising:

providing a first coated abrasive roll comprising first and second end portions and a first mating portion positioned on at least the second end portion; and providing a second coated abrasive roll comprising first and second end portions and a second mating portion positioned on at least the first end portion, the second coated abrasive roll being distinct from the first coated abrasive roll, wherein the first and second mating portions have substantially the same geometric shape, each of the first and second mating portions include an opening and a projection, each opening extending through the thickness of the respective mating portion and surrounded by the mating portion, the opening of the first mating portion shaped to receive the projection of the second mating portion and the opening of the second mating portion shaped to receive the projection of the first mating portion, the first mating portion is configured to couple with the second mating portion including at least one of (i) the opening of the first mating portion is configured to interconnect with the projection of the second mating portion without the use of an adhesive, and (ii) the projection of the first mating portion is configured to interconnect with the opening of the second mating portion without the use of an adhesive.

10. The method of claim 9, further comprising a step of providing a tool to form at least one of the first and second mating portions.

11. The coated abrasive system of claim 1, wherein each of the projections extends longitudinally from the respective end portion.

* * * * *